US005569016A

United States Patent [19]

Mokler

[11] Patent Number: 5,569,016

[45] Date of Patent: Oct. 29, 1996

[54] MULTIPLE CONVEYOR STACKING APPARATUS

[75] Inventor: Bernhard Mokler, Markgröningen, Germany

[73] Assignee: LTG Lufttechnische Gesellschaft M.B.H., Stuttgart, Germany

[21] Appl. No.: 457,065

[22] Filed: Jun. 1, 1995

[30] Foreign Application Priority Data

Sep. 23, 1994 [DE] Germany ..... 44 33 912.7

[51] Int. Cl.[6] ..... B65G 57/04

[52] U.S. Cl. ..... 414/793.1; 414/793.3; 414/793; 414/903; 271/182; 271/183

[58] Field of Search ..... 414/793, 793.1, 414/793.3, 794.4, 903; 271/182, 183, 69, 197, 195, 211; 198/460.1, 462.1, 462.2, 463.3

[56] References Cited

U.S. PATENT DOCUMENTS

| | | | |
|---|---|---|---|
| 2,527,911 | 10/1950 | Buccicone | 414/793.3 |
| 2,766,043 | 10/1956 | Buccicone | 414/793.3 |
| 2,897,952 | 8/1959 | Buccicone | 271/69 |
| 3,202,302 | 8/1965 | Insolio | 414/793.1 |
| 3,232,605 | 2/1966 | Plummer et al. | 271/183 |
| 3,359,648 | 12/1967 | Overly et al. | 414/793.1 |
| 3,908,835 | 9/1975 | Lubas | 414/793.1 |
| 4,157,177 | 6/1979 | Strecker | 414/793.1 |
| 4,381,596 | 5/1983 | Simonton et al. | 414/793.1 |
| 4,436,302 | 3/1984 | Frye et al. | 271/183 |

FOREIGN PATENT DOCUMENTS

| | | | |
|---|---|---|---|
| 1358778 | 3/1964 | France | 271/195 |
| 54-0040478 | 3/1979 | Japan | 414/793.3 |

*Primary Examiner*—Karen Merritt
*Assistant Examiner*—Douglas Hess
*Attorney, Agent, or Firm*—Anderson, Kill, Olick P.C.

[57] ABSTRACT

An apparatus for stacking sheet-like products delivered one after another in a spaced relationship to each other with a transporting device, including a conveyor arranged above a transporting plane of the transporting device for conveying the delivered sheet-like products to a stacking position, and a braking device located beneath the conveyor, with the conveyor having a conveying surface provided with suction openings or magnets for lifting the sheet-like products off the transporting device and for retaining the sheet-like products as they are conveyed to the stacking position.

9 Claims, 1 Drawing Sheet

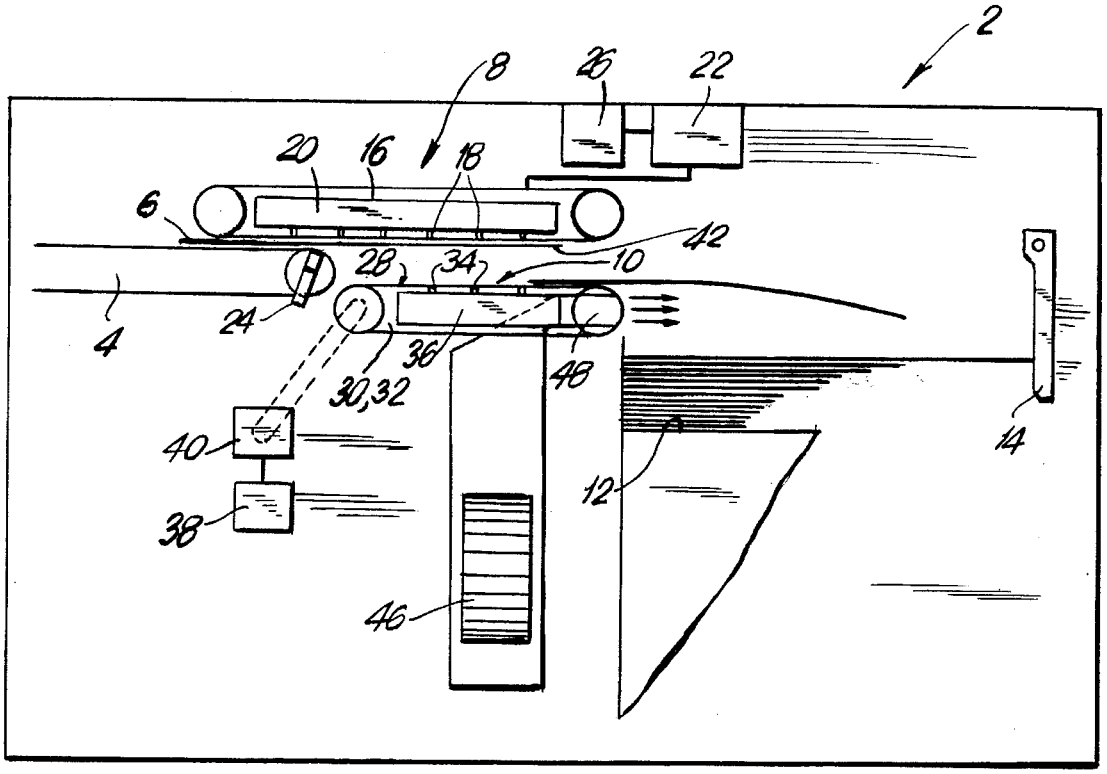
2
8
26
22
20
16
18
6
42
10
28
34
24
4
36
48
30,32
40
38
12
14
46

MULTIPLE CONVEYOR STACKING APPARATUS

BACKGROUND OF THE INVENTION

The present invention relates to an apparatus for stacking sheet-like products delivered one after another in a spaced relationship to each other with a transporting device, which apparatus includes a conveyor for conveying the sheet-like products toward a stacking position and a braking arrangement. Generally, the speed of the conveyor corresponds to the speed of the transporting device.

Such an apparatus is used, for example, with a sheet metal drier to insure its continuous operation. The metal sheets, which leave the drier, e.g., lacquered metal sheets, are delivered one after another by a transporting device to a stacker with a very high speed of about 6,000–10,000 sheets per hour. However, braking of the sheets during their deposition onto a piling table is rather difficult. With sudden braking, the sheets can be damaged. Further, stacking is complicated by the back pressure applied by buffer or resilient stop elements generally provided at the end of the piling table.

It was suggested already to decelerate the sheet-like products before they reach their stacking position or the piling table. To prevent a collision of a following sheet with the braked sheet, it was suggested to provide for overlapping or slat feeding of sheets during sheet braking. Such an apparatus is described in German application P43 14 760 7 of the assignee of the present application. In this apparatus, the conveyor is formed as a conveyor belt, and the braking device is arranged downstream of the conveyor in the transporting direction and beneath the transporting plane of the conveyor. After the rear edge of a sheet leaves the conveyor, it is deposited on the braking device and is decelerated thereby. During the deceleration, the front edge of the following non-decelerated sheet overlaps the rear edge of the decelerating sheet. The decelerated sheet is conveyed with a reduced speed to the piling table and is deposited thereon.

However, during the deposition of the sheets, they or already stacked sheets can be easily damaged. Thus, the front edge of the following sheet can damage the surface of the preceding decelerated sheet when it impacts the same and is pushed therealong.

Accordingly, a main object of the invention is a stacking apparatus which would insure damage-free stacking of sheet-like products delivered at high speed.

SUMMARY OF THE INVENTION

This and other objects of the invention, which will become apparent hereinafter, are achieved by arranging the conveyor for conveying the sheet-like products to a stacking position, above a transporting plane of the transporting device, which feeds the sheet-like products to the conveyor, with the conveyor including a conveying surface provided with suction openings for lifting the sheet-like products off the transporting device and for retaining the sheet-like products as they are conveyed to the stacking position, and by arranging the braking device beneath the conveyor.

The apparatus according to the present invention enables contactless overlapping of the stackable sheets. The apparatus conveyor which, as it has already been indicated above, is driven with substantially the same speed as the transporting device, lifts the sheets off the transporting device and carries them toward the stacking position. When the sheets arrive at the drop-off position above the braking device, the vacuum is turned off, and the sheets fall onto the braking device and are decelerated thereby. During the deceleration, the front edge of the following sheets overlaps the rear edge of the decelerating sheet. Because the conveyed and decelerated sheets are spaced from each other, the impact of the front edge of the following sheets on the surface of the decelerating sheets is prevented.

The conveyor can be formed by plate-like elements connected with each other. However, advantageously, the conveyor is formed by a suction belt. The sheet-like products abut a yielding surface of a belt material very well, which insures a complete adherence of the sheet-like products to the belt surface and thereby a reliable aspiration of the sheet-like products to the belt surface.

As it has already been indicated above, the braking device of the inventive apparatus is located beneath and preferably parallel to the conveyor. The braking device of the inventive apparatus comprises an impacted receiving surface. The conveyed sheet-like products, when reaching the drop-off position, after turning-off of vacuum, fall onto the receiving surface of the braking device, which receiving surface advantageously is provided with suction opening communicating with a vacuum device.

According to the invention, the receiving surface of the braking device forms advantageously the conveying surface of the braking device. The conveying surface of the braking device can be driven with a constant speed which is lower than the conveyor speed. However, the conveying surface of the braking device can be driven with a variable speed, e.g., with a first speed corresponding to the conveyor speed, so that the sheet-like products falling off the conveyor onto the conveying surface of the braking device are displaced thereon with the same speed until the braking process begins. The braking of the deposited on the conveying surface sheet-like products is preferably effected in the rear region thereof. The braking device includes a control unit for controlling application of vacuum to the conveying surface of the braking device. As it has already been discussed above, braking is effected with a second speed of the conveyor surface of the braking device, which is lower than the first, sheet-like product receiving speed of the conveying surface of the braking device. After the deposition of the sheet-like product onto a stack, the speed of the conveying surface of the braking device is accelerated to the first speed. Thus, the speed of the sheet-like products carried by the conveying surface of the braking device is decelerated upon braking of the conveying surface. The foregoing braking device insurers obtaining of a very precise and reproducible braking process. The conveying surface of the braking device can be formed in the same way as the conveying surface of the conveyor, i.e., by a suction belt.

To insure a high precision of the deposition of the sheet-like products from the apparatus conveyor onto the braking device, there is provided a control device for controlling application of vacuum to the suction openings of the conveying surface of the conveyor. The control device includes a position sensor which defects the position of the sheet-like products on the conveying surface of the conveyor. For effecting the drop-off of the sheet-like products from the conveying surface of the conveyor, the suction opening of this conveying surface are advantageously connectable with a high-pressure source, e.g., an air pressure source. Alternatively, the conveying surface of the conveyor can contain first openings communicating with a vacuum source and second openings communicating with the high-pressure source. Advantageously, the control device of the conveyor is connected with the control unit of the braking device, which insures synchronous operation of the conveyor and the braking device. Of course, mechanical elements for dropping the sheet-like products off the conveying surface of the conveyor may be used.

Advantageously, there is provided beneath the braking device in the downstream region thereof, a blower including a nozzle which opens toward the stacking position or the piling table. The nozzle forms an air column which prevents impacting of the front edge of the deposited sheet-like product on the uppermost sheet-like product of the stack and, thus, prevents any damage to the uppermost sheet-like product. The air column retains the deposited sheet-like product in a suspended state assuring its smooth deposition. The air column further insures that the following sheet does not collide with the previous sheet.

A stop element provided at the far end of the piling table absorbs the residual kinetic energy of the deposited-on-the table sheet-like products.

Instead of equipping the conveyor with vacuum means for lifting off and conveying the sheet-like products, the conveyor can be equipped with magnet means, advantageously, controllable electromagnet means, when the inventive apparatus is used for stacking magnetized sheet-like products.

BRIEF DESCRIPTION OF THE DRAWINGS

The objects and features of the present invention will become more apparent and the invention itself will be best understood from the following detailed description of the preferred embodiment when read with reference to the accompanying drawings, wherein:

SINGLE FIGURE shows a side view of an apparatus for stacking of sheet-like products according to the present invention.

DETAILED DESCRIPTION OF THE PREFERRED EMBODIMENT

An apparatus for stacking of sheet-like product according to the present invention and shown in the Figure is designated with a reference numeral 2. The stacking apparatus or stacker 2 is designed for stacking metal sheets 6 fed with a high-speed transporting device 4. The stacker 2 includes a conveyor 8, a braking device 10 and a piling table 12 having a support surface limited by a resilient stop member 14.

The conveyor 8 is formed of a suction belt 16, which is provided with suction openings 18 communicating with a vacuum chamber 20 which is connected to a vacuum source 22.

The metal sheets 6 are fed with a high speed by a transporting device 4 and are lifted off by the conveyor 8, arranged above the plane of the transporting device 4. The sheet 4 are aspirated to the surface of the belt 16. By application of vacuum to the suction openings 18, a metal sheet 6 is fixedly held on the suction belt 16. After the metal sheet 6 leaves the transporting device 4, which is determined by a position sensor 24, a control device 26 in response to a sensor signal turns off the vacuum device 22, and the metal sheet drops onto an impact surface 28 of the braking device ID. The impact surface 28 is defined by a displaceable conveyor surface 30 formed by a second suction belt 32. The second suction belt 32 is likewise provided with suction openings 34 communicating with a vacuum chamber 36 connected with another vacuum source (not shown). The second belt 32 can be driven with an accelerating or decelerating speed and, when receiving a metal sheet dropped off the conveyor 8, is preferably driven with substantially the same speed as the conveyor 8. The dropped off metal sheet is aspirating to the surface of the belt 32 and is conveyed toward the pilling table 12. Upon reaching its braking position, the speed of the metal sheet carried thereby is reduced by the second control device 38 which controls the drive 40 of the second suction belt 32. The braking of the second suction belt 32 is preferably effected only then when only the rear portion of the metal sheet carried thereby adheres to the belt. During the deceleration, the front portion 42 of the following metal sheet is moved above the rear edge of the braked metal sheet. However, because the following metal sheet is located above the braked metal sheet and is spaced for the braked metal sheet, there is no contact between the sheets and no damage of a metal sheet occurs.

Immediately before the piling table 12 and beneath the conveying surface 30 of the second suction belt 32, there is provided a nozzle 48 which is connected to a blower 46. The nozzle 48 forms an air column between the upper sheet of the stack on the piling table 12 and the sheet deposited thereon. The air column prevents the front edge of the deposited sheet from striking the uppermost sheet of the stack and thereby any damage of the uppermost sheet. Further, the operation of the nozzle 48 results in smooth deposition of the metal sheet onto the stack. Thus, the air column prevents any collision between the deposited sheet and the stack.

Though the present invention was shown and described with reference to the preferred embodiments, various modification thereof will be apparent to those skilled in the art and, therefore, it is not intended that the invention be limited to the disclosed embodiments and details thereof, and departure may be made therefrom within the spirit and scope of the present invention as defined in the appended claims.

What is claimed is:

1. An apparatus for stacking sheet products delivered one after another in a spaced relationship to each other at a predetermined speed by a transporting device, said stacking apparatus comprising:

conveyor means arranged above a transporting plane of the transporting device for lifting the sheet products from the transporting device and for conveying the sheet products in a direction toward a stacking position at a speed corresponding to the predetermined speed;

braking means located beneath the transporting plane of the transporting device, said braking means having a receiving surface defining a conveying surface of said braking means and formed by an upper surface of a conveyor belt;

drive means for driving said conveyor belt with a first speed corresponding to the predetermined speed and a second reduced speed when said conveyor belt reaches the stacking position; and control means for controlling lifting of the sheet products by said conveyor means and depositing of the sheet products from said conveyor means on the receiving surface of said braking means.

2. A stacking apparatus as set forth in claim 1 wherein said conveyor means comprises one of vacuum means and magnetic means for lifting the sheet products off the transporting device.

3. A stacking apparatus as set forth in claim 2, wherein said conveyor means comprises vacuum means, and wherein said vacuum means comprises suction openings formed in a conveying surface of said conveying means.

4. A stacking device apparatus as set forth in claim 2, wherein said conveyor means comprises magnetic means, and wherein said magnetic means comprises an electromagnet controlled by said control means.

5. A stacking apparatus as set forth in claim 1, further comprising means for applying vacuum to suction openings of said conveying surface of said conveyor means for lifting the sheet products off the transporting means and for applying pressure to said suction openings for depositing the sheet products onto said braking means.

6. A stacking apparatus as set forth in claim 5, wherein said control means comprises position sensors for sensing positions of the sheet products, and wherein said control means controls operation of said vacuum applying means in accordance with signals generated by said position sensors.

7. A stacking apparatus as set forth in claim 1, further comprising blower means located beneath one of the receiving surface and the entire braking means and including a nozzle opening in the direction toward the stacking position.

8. A stacking apparatus as set forth in claim 1, wherein said conveyor means includes mechanical push-off means for depositing the sheet products onto the braking means.

9. A stacking apparatus as set forth in claim 1, wherein said receiving surface of said braking means comprise suction openings connectable with a vacuum source for retaining the sheet products on said receiving surface.

* * * * *